US005189243A

United States Patent [19]

Hambric

[11] Patent Number: 5,189,243

[45] Date of Patent: Feb. 23, 1993

[54] MINEFIELD CLEARING APPARATUS

[76] Inventor: Harry N. Hambric, 5350 Wade La., Woodbridge, Va. 22192

[21] Appl. No.: 868,845

[22] Filed: Apr. 16, 1992

[51] Int. Cl.[5] ..... F41H 11/12; F41F 3/02

[52] U.S. Cl. ..... 89/1.13; 171/105; 171/106; 171/124; 171/130

[58] Field of Search ..... 171/104, 105, 106, 84, 171/130, 131, 124

[56] References Cited

U.S. PATENT DOCUMENTS

| | | | |
|---|---|---|---|
| 76,851 | 4/1868 | Tittle | 171/105 |
| 942,626 | 12/1909 | Dunham et al. | 171/131 |
| 1,786,464 | 12/1930 | Thomsen | 171/105 |
| 4,467,694 | 8/1984 | Azulai et al. | 89/1.13 |
| 4,491,053 | 1/1985 | Bar-Nefy et al. | 89/1.13 |
| 4,552,053 | 11/1985 | Bar-Nefy et al. | 89/1.13 |
| 4,590,844 | 5/1986 | Bar-Nefy et al. | 89/1.13 |
| 4,667,564 | 5/1987 | Schreckenberg | 89/1.13 |
| 4,690,030 | 9/1987 | Bar-Nefy et al. | 89/1.13 |
| 4,727,940 | 3/1988 | Bar-Nefy et al. | 171/84 |
| 4,909,330 | 3/1990 | Kasher et al. | 172/4 |
| 4,919,034 | 4/1990 | Firth | 89/1.13 |
| 4,938,114 | 7/1990 | Matthews et al. | 89/1.13 |
| 5,097,911 | 3/1992 | Kendall | 89/1.13 |
| 5,103,623 | 4/1992 | Herritt | 171/131 |

*Primary Examiner*—David H. Brown
*Attorney, Agent, or Firm*—Richard C. Litman

[57] ABSTRACT

A minefield clearing apparatus for attachment to a vehicle and having: an interface assembly for raising and shunting aside mines and other objects buried below the ground surface including: an articulated rake having a pluraity of plow teeth which, in operation, extend below the ground surface; and a conveyor apparatus extending along the side of the vehicle and adapted to transport the contents of the earth raised by the articulated rake to the rear of the vehicle.

17 Claims, 6 Drawing Sheets 4
6
12
13
14
15
17
18
19
20
21
22
23
30
50
51

MINEFIELD CLEARING APPARATUS

FIELD OF THE INVENTION

The present invention relates to explosive mine destroying devices employed in wartime activities. In particular, it relates to a plowing device mountable on a tank or other armored vehicle for raising and shunting aside mines and unexploded ordinance buried beneath the ground surface. A mine collecting ramp located behind the device's plow face directs the uncovered contents of the earth to a chute having a conveyor bet for separation from soil, inspection and final disposal away from the vehicle's path.

BACKGROUND OF THE INVENTION

Modern warfare has become highly mechanized. Foot soldiers of today are supported by an array of technological marvels. Supersonic aircraft and long range missiles pierce enemy territory from the air while heavily fortified tanks and high speed troop carriers enhance capabilities upon the ground. Both air and ground support are crucial in the winning of a battle. The failure of either may spell the difference between victory and defeat.

Land mines have been developed to neutralize an opponent's ground support capabilities. These simple yet effective devices, buried below the ground's surface avoiding ready detection, explode violently when triggered. Triggering may be caused by: pressure exerted by a soldier's boot, vibration transmitted to the ground by a passing vehicle, or movement of a metallic object through a magnetic field. The explosive force of some mines is so great that a heavily armored and fortified tank may be destroyed.

Various systems have been developed to detect and remove land mines from the path of oncoming troops and equipment. One such system utilizes a plow mounted on the front of a tank and driven through the soil to expose and sweep aside mines. These mine plows have been effective when combined with powerful, heavy tanks since, their power and tractive ability easily propel the plow through roots, clay, or uneven terrain.

The standard mine plow has two separate blades for cutting the earth and exposing mines. These blades are generally oriented in V-shaped fashion at the front of a tank or other vehicle. When driven forward through the ground surface, two earthen berms are formed of spoil material pushed tangentially along the blades away from the path of the vehicle. The spoil material often contains mines and other unexploded ordinance which did not detonate upon contact with the plow.

While V-shaped blades provide adequate protection for a single vehicle equipped with such, they are impractical for clearing large areas of mines. In clearing large areas, the plow is usually systematically moved in parallel paths across the entirety of the target area. Without overlapping the paths by a minimum of one half of the V-shaped blades, overall width, one can not be assured that the area being cleared is indeed free of mines. Such an overlap prevents previously exposed berm material from being plowed back into the previously cleared area. Due to the inefficiency of the currently available mine clearing devices in eliminating mines from large areas, a need has arisen for a more efficient device.

DESCRIPTION OF THE RELATED ART

Attempts have been made to overcome some of the deficiencies associated with prior art plows. Nonetheless, most of the development in the art has been concentrated upon improving plows with deficient V-shaped blades.

U.S. Pat. No. 4,467,694 issued Aug. 28, 1984 to Azulai et al discloses a mine clearing apparatus having two widely spaced plow blades oriented so as to form a "V" and a frame mountable to a vehicle for selectable positioning in a raised or lowered orientation.

U.S. Pat. No. 4,491,053 issued Nov. 12, 1985 to Bar-Nefy et al describes a minefield clearing apparatus mountable upon a vehicle having two widely spaced plow blades oriented so as to form a "V" and apparatus for automatically raising the plow from its lowered orientation to its raised orientation in response to backwards motion of the vehicle.

U.S. Pat. No. 4,552,053 issued Nov. 12, 1985 to Bar-Nefy et al shows a minefield clearing apparatus mountable upon a vehicle having two widely spaced plow blades oriented so as to form a "V", such blades have two plow sections. An upper section moves soil, sliced by the teeth of the lower section, laterally.

U.S. Pat. No. 4,590,844 issued May 27, 1986 to Bar-Nefy et al discloses a minefield clearing apparatus for attachment to a vehicle having two widely spaced plow blades so as to form a "V" which may be raised or lowered automatically from inside the vehicle.

U.S. Pat. No. 4,667,567 issued May 26, 1987 to Schreckenberg describes an apparatus for clearing light land mines provided with clearing elements which can freely move up and down independently of one another and which are disposed in a V-shaped movable carrier attachable to a vehicle.

U.S. Pat. No. 4,690,030 issued Sep. 1, 1987 to Bar-Nefy et al provides a minefield clearing apparatus for attachment to a vehicle having two widely spaced plow blades oriented so as to form a "V" and being a continuation-in-part of U.S. Pat. No. 4,590,844.

U.S. Pat. No. 4,727,940 issued Mar. 1, 1988 to Bar-Nefy et al discloses a tank mounted minefield clearing apparatus having a single plow section mounted parallel to the front of a vehicle and having a conveyor apparatus extending along the length of the plow section adapted to convey the contents of the earth raised by the plow section to one side of the vehicle.

U.S. Pat. No. 4,909,330 issued Mar. 20, 1990 to Kasher et al describes an automotive earth moving vehicle for civil and military applications having a blade which is comprised of two horizontally linked segments adapted to alternate between a single plane dozer mode and a V-shape plow mode.

U.S. Pat. No. 4,919,034 issued Apr. 24, 1990 to Firth discloses a mine clearing apparatus having at least one plow blade and mounted in such a way that such a blade is pivotable about two axes. The preferred embodiment of the invention discloses an apparatus with two separate blades orientated in V-shaped fashion.

U.S. Pat. No. 4,938,114 issued Jul. 3, 1990 to Matthews et al shows a mine clearing apparatus having float shoes that slide along the ground and adjust to maintain a chosen plowing depth. The float shoes are caused to move by powered adjusting means mounted upon a crossbeam and controlled by sensing means. The preferred embodiment of the inventive apparatus is provided with two blades oriented in V-shaped fashion.

None of the above inventions and patents, taken either singly or in combination, is seen to describe the instant minefield clearing apparatus as claimed.

SUMMARY OF THE INVENTION

The present inventive minefield clearing apparatus seeks to overcome the difficulties and disadvantages possessed by the aforementioned prior art devices.

Accordingly, it is a principal object of the invention to provide an improved minefield clearing apparatus which will deposit only one berm as a result of its plowing action.

It is another object of the invention to provide a minefield clearing apparatus with a ramp placed immediately behind the plow face for collecting mines and other objects exposed by plowing.

It is still another object of the invention to provide a minefield clearing apparatus with a rake extension member for directing mines and other objects exposed by plowing toward the ramp.

It is a further object of the invention to provide a minefield clearing apparatus with a conveyor belt for transporting mines and other objects exposed by plowing from the front of the vehicle to which the inventive apparatus is attached to its rear.

Still another object of the invention is to provide a minefield clearing apparatus with an improved interface assembly for secure attachment to a vehicle.

It is an additional object of the invention to provide a minefield clearing apparatus with a segmented plow face permitting pivotal movement of each segment about an axis substantially parallel to the path of travel of the vehicle to which the apparatus is attached.

It is an object of the invention to provide improved elements and arrangements thereof in a minefield clearing apparatus for the purposes described which is inexpensive, dependable and fully effective in accomplishing its intended purposes.

These and other objects of the present inventive minefield clearing apparatus will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
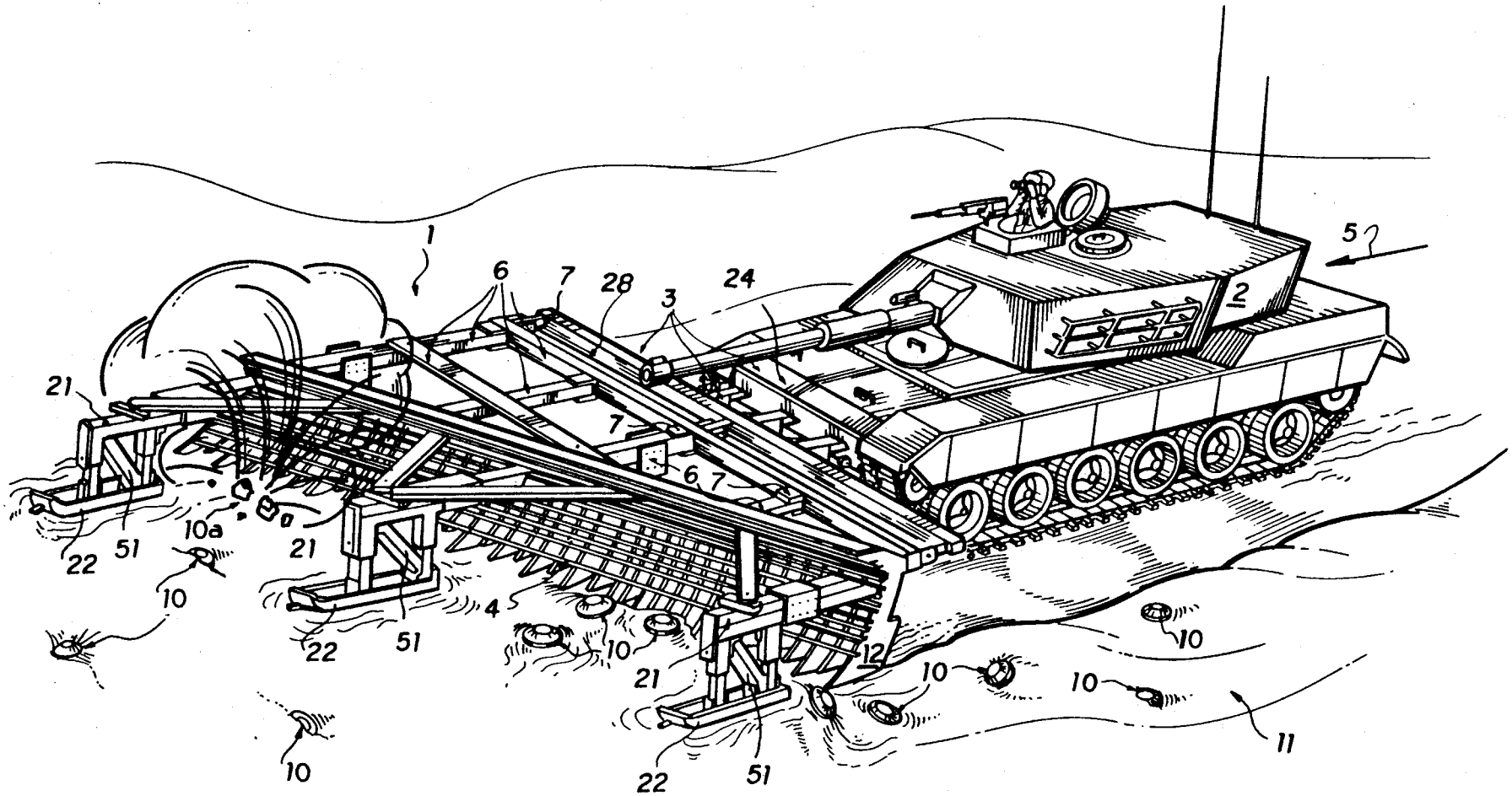
FIG. 1 is an environmental perspective view of a minefield clearing apparatus attached to the front a tank with the plow face in a lowered orientation for plowing.

Referring now to the drawings a minefield clearing apparatus 1 is shown in FIG. 1 attached to the front of a tank 2. The apparatus 1 has: an interface assembly 3 which is rigidly fixed to the front of the tank 2; a singular plow face 4 which extends traversely of the path of forward travel of tank 2 being the same as the longitudinal axis 5 of the tank 2; and frame G reinforcing the plow face 4 and being joined by pins 7 to interface assembly 3.

Figure 2:
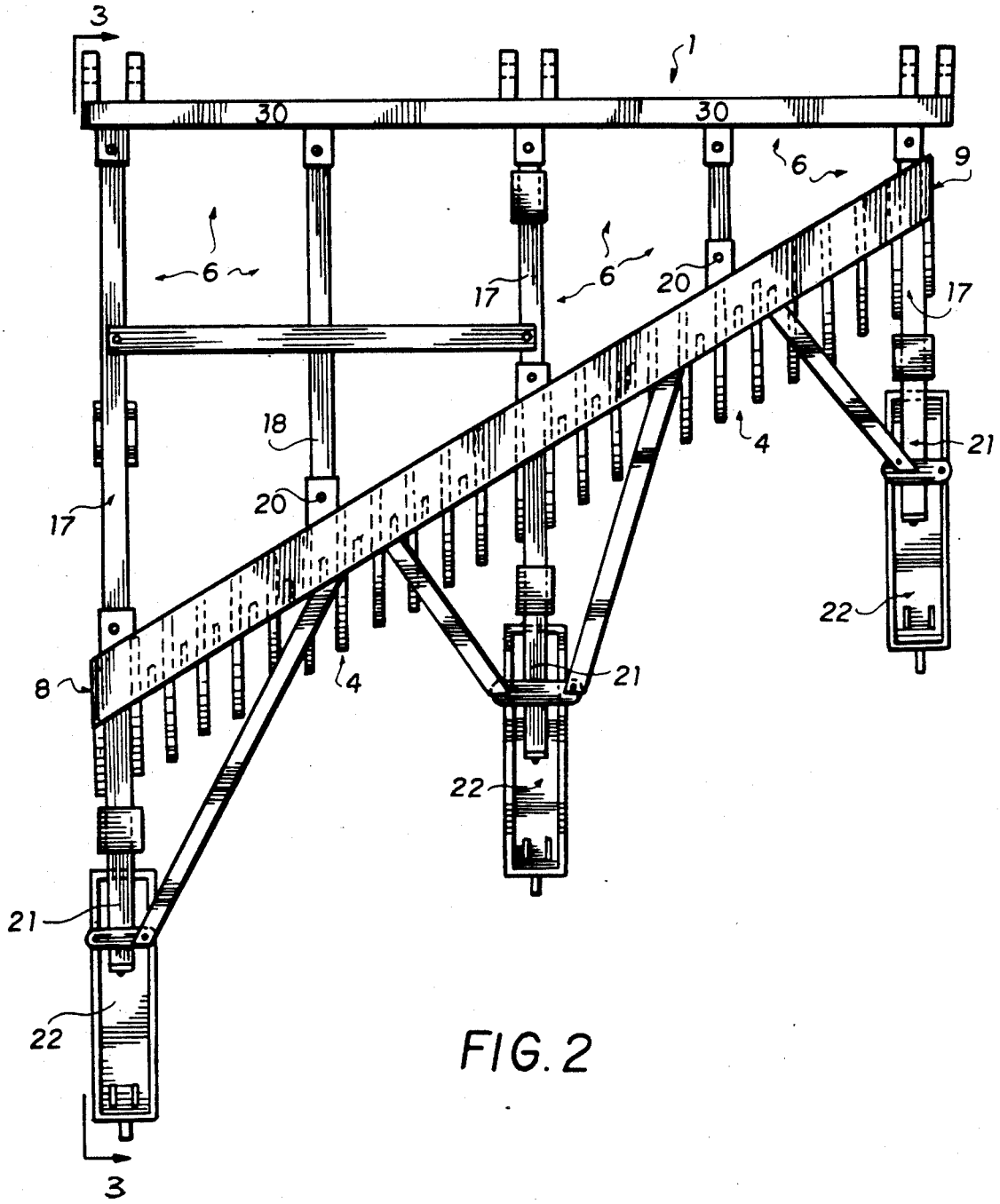
FIG. 2 is a plan view of a minefield clearing apparatus.

It will be seen in FIG. 2 that the plow face 4 is attached to frame 6 having a shape, when viewed from above, similar to that of a right triangle. Plow face 4 extends laterally and inwardly from its distal end 8 to its inner end 9 being closer to tank 2. During minefield clearing operations as the plow face 4 is moved through the ground surface, mines 10, unexploded ordinance, or other objects unearthed by plow face 4 will move along the front of plow face 4 and will he deposited as part of an earthen berm 11 adjacent to end 9 and outside of the path of the tank 2.

Figures 3, 4:
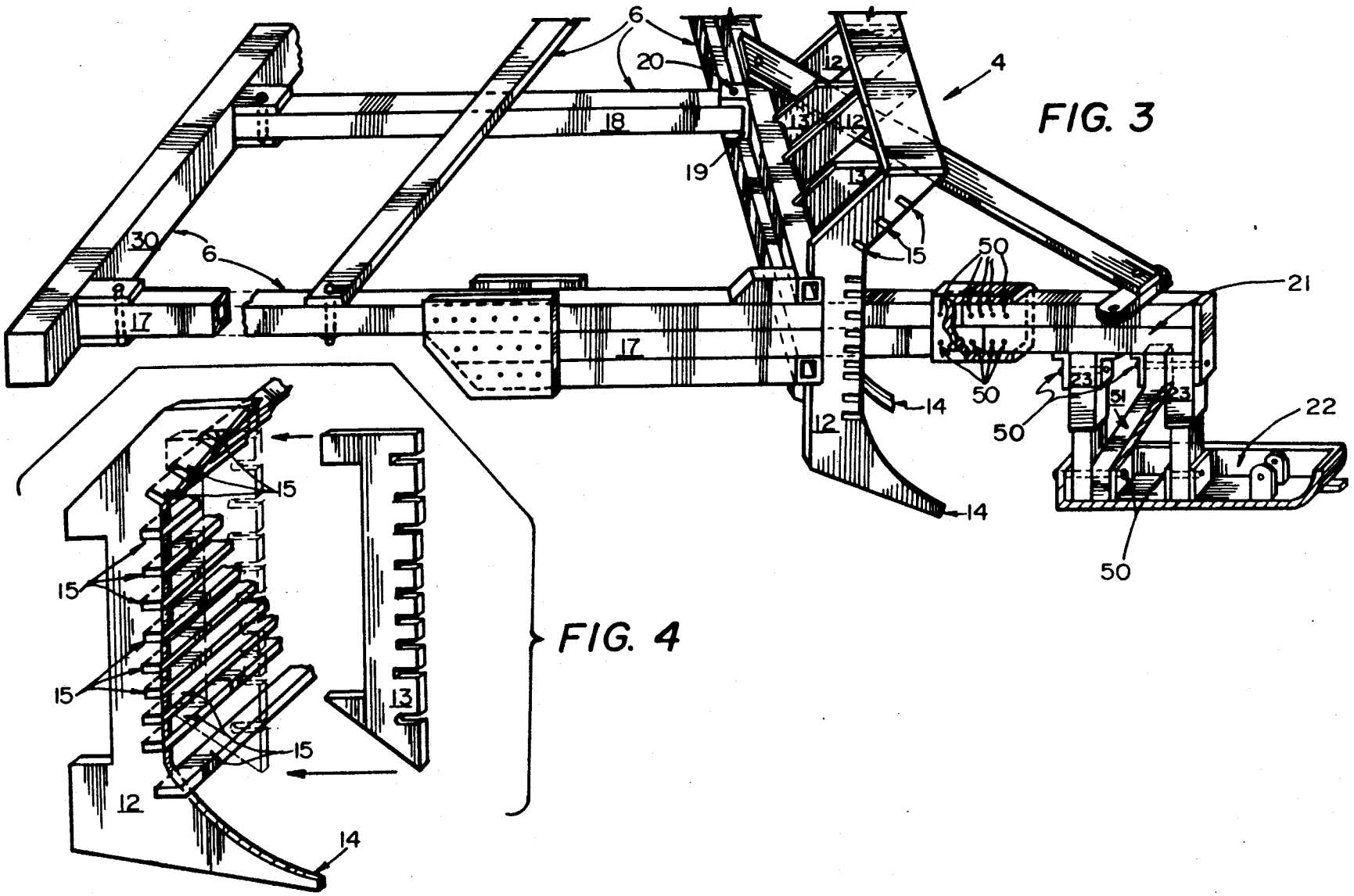
FIG. 3 is a side perspective view of a minefield clearing apparatus with a portion thereof broken away showing details of the plow face and frame.
FIG. 4 is a perspective view of the plow face showing teeth detail.

The plow face 4 is provided with a row of teeth 12 and 13 alternatingly positioned along its length and is best seen in FIGS. 3 and 4. Teeth 12 have a forward facing projection 14 assisting in lifting objects buried beneath the ground surface. Each of teeth 13 has a substantially vertical leading edge without a forward facing projection. Teeth 13 provide the plow face 4 with added ground cutting ability and strength. Teeth 12 and 13 are joined by horizontal stiffening members 15. Stiffening members 15 are vertically separated from one another, span the length of the plow face 4 and join adjacent teeth 12 and 13. During minefield clearing operations, teeth 12 and 13 and stiffening members 15 form a lattice or grid permitting objects of small size to pass therebetween while simultaneously retaining objects of larger dimensions such as mines. The grid additionally reduces drag upon the plow face 4 while in use since a significant quantity of earthen material which would otherwise be retained against the plow face 4 and plowed into berm 11 will return to the ground surface with little movement.

The teeth 12 and 13 are mounted to rails 16 comprising the leading edge of frame 6, and extend outwardly therefrom. Rails 16 reinforce the plow face 4 and are supported above and below by push beam assemblies 17. Additional support for the rails 16 is provided by intermediate push bars 18 which are joined to brackets 19 by pins 20.

Attached to the forward ends of push beam assemblies 17 are skid shoe bearing arms 21 and supporting shoes 22 best seen in FIG. 3. It is contemplated that each skid shoe bearing arm 21 will be of identical configuration and interchangeable. Damage caused in the field by an exploding mine 10*a* can be efficiently repaired by replacement of arm 21 or attached shoe 22 which may be joined, to each other and to push beam assemblies 17, by removable pins 50 or other fastening devices. The ground engaging skid shoe 22 is adjustable in height. Altering the depth at which the teeth 12 and 13 penetrate the ground surface is accomplished by manual adjustment of telescoping legs or supports 23 which, in turn, raise or lower the attached skid shoe 22. Brace support bar 51 of appropriate length may be fastened to the telescoping legs 23 providing additional support thereto.

Figure 5:
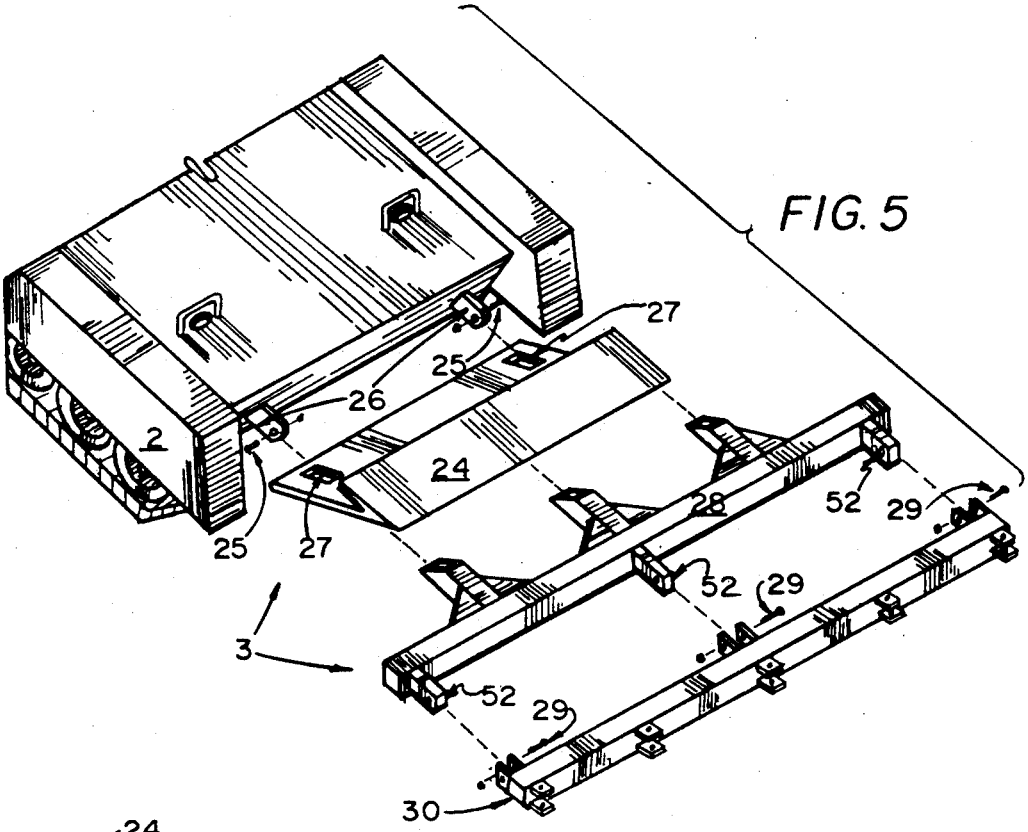
FIG. 5 is an exploded perspective view of the interface assembly showing its orientation when mounted upon a tank and the relative positioning of the transverse push beam.
Figure 6:
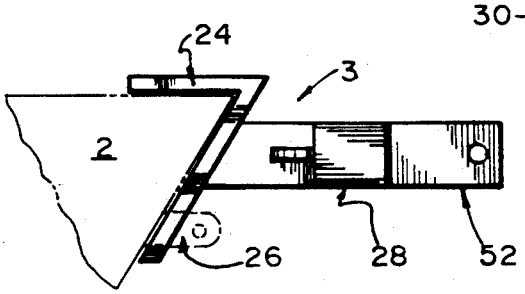
FIG. 6 is a side view of the interface assembly mounted upon a tank (shown by dashed lines).
Figure 7:
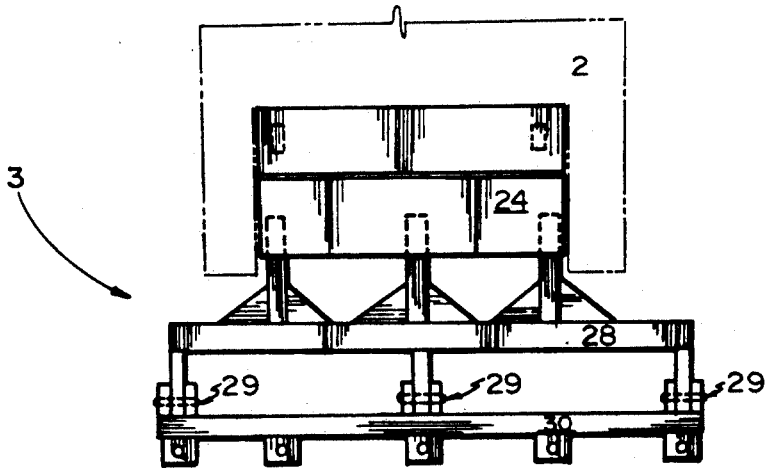
FIG. 7 is a plan view of the interface assembly mounted upon a tank (shown by dashed lines), transverse push beam attached.

The interface assembly 3 joins the minefield clearing apparatus 1 to a vehicle such as tank 2 and is best seen in FIGS. 5, 6, and 7. The interface assembly 3 has a mounting hood 24 which may be manufactured with various cross sectional configurations in order to closely fit the vehicle to which it is to be attached. Nonetheless, the configuration disclosed in the preferred embodiment has a V-shaped cross section. The hood 24 is joined by pins 25 fitted through mount locks 26 integrally joined to the tank 2. The mount locks 26 pass through holes 27 placed in the hood 24. Extending horizontally forward from the mounting hood 24 is a hinge bar 28 to which frame 6 may he joined. Joining is accomplished by inserting pins 29 through aligned holes in hinge bar brackets 52 and transverse push beam 30.

Figure 8:
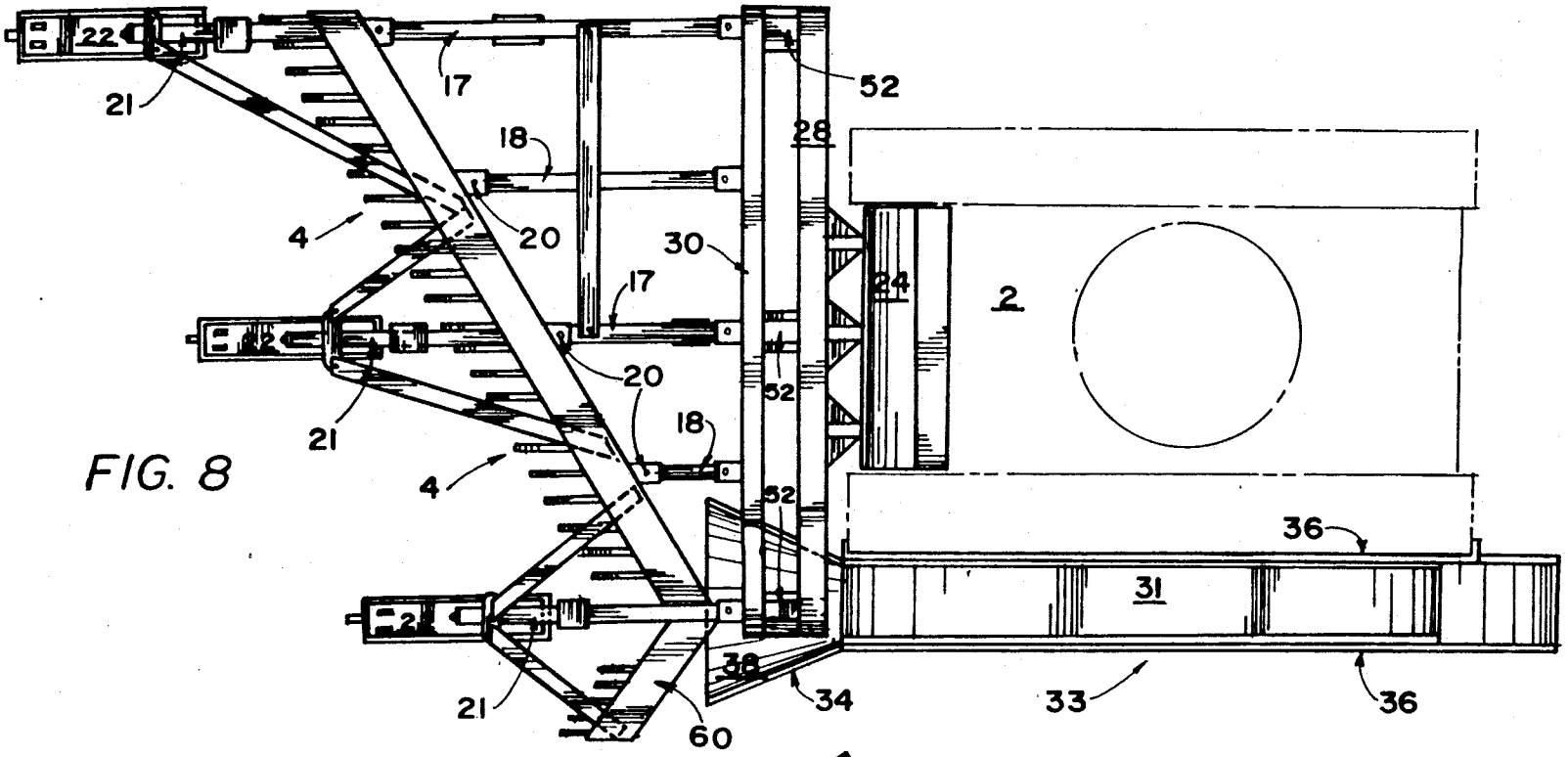
FIG. 8 is a plan view of an alternative embodiment of a minefield clearing apparatus showing the relative positions of the rake extension member, mine collecting chute, and mine collecting ramp.
Figure 9:
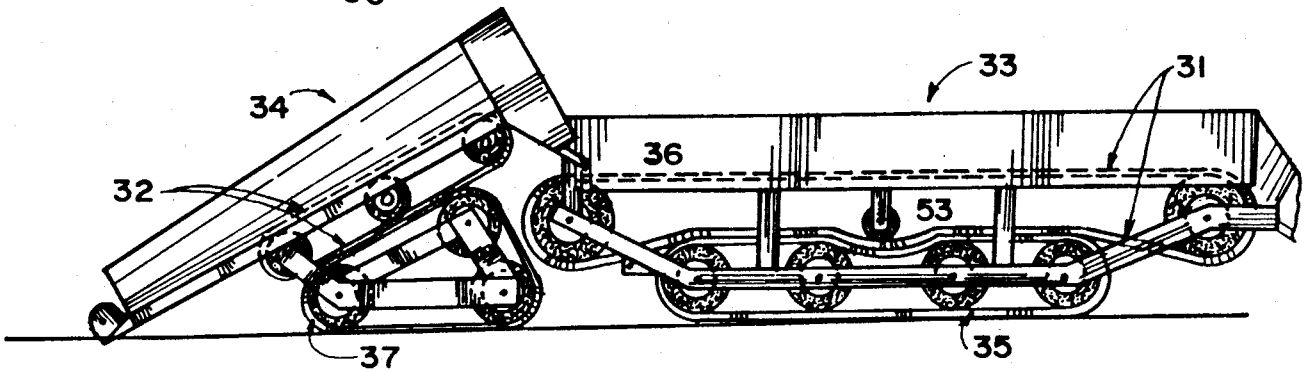
FIG. 9 is a side elevational view of the mine collecting chute and mine collecting ramp showing their relative positioning as components of the apparatus of FIG. 8.

A second embodiment of a minefield clearing apparatus shown in FIGS. 8 and 9. This particular embodiment of the apparatus provides conveyor belts 31 and 32 for transporting the contents of the earth raised by the plow face 4 to the rear of the vehicle along a line substantially parallel to the direction of travel of the vehicle. Conveyor belts 31 and 32 are mounted within a mine collecting chute 33 and mine collecting ramp 34 respectively. The chute 33 forms a continuous channel from the front to the rear of the vehicle permitting movement of contents of the earth uncovered by the plow face 4 therein. The chute 33 has a first continuous belt track 35 for support above the ground surface and first side walls 36 mounted perpendicularly to each other above track 35 for retaining materials. Track 35 is capable of being rotated when the tank 2 is driven over the ground surface and may be frictionally engaged by roller 53 with conveyor belt 31 which forms the floor of the chute 33. When engaged, the motion of tank 2 over the ground surface will cause belt 31 to turn. The ramp 34, on the other hand funnels and lifts the contents of the earth uncovered by plow face 4 to a height above the ground surface and deposits such within chute 33. The ramp 34 has a second continuous belt track 37 for support and a belt 32 forming a portion of the ramp floor 38. Track 37 is capable of being rotated when the tank 2 is driven over the ground surface and in a manner similar to that described for belt 31, motion may be imparted to conveyor bet 32.

As conveyor belts 31 and 32 are directly driven by continuous belt tracks 35 and 37, their speed of rotation is dependent upon the speed of the vehicle over the ground surface. While the vehicle is moving slowly over the ground surface, belts 31 and 32 will rotate slowly. As the vehicle accelerates, belts 31 and 32 will accelerate and an increased flow of materials may be transported over them. When the vehicle comes to rest belts 31 and 32 will stop.

Funneling objects buried beneath the ground surface uncovered by plow face 4 to ramp 34 is a rake extension member 60, having teeth 12 and 13 mounted thereon in a fashion similar to plow face 4, angularly joined to frame 6. Member 60 extends from inner end 9 of the plow face 4 forward and away from tank 2. This "funnel" prevents mines and unexploded ordinance from bypassing the ramp 34 increasing confidence that the area plowed by the instant minefield clearing apparatus is free of mines.

Figure 10:
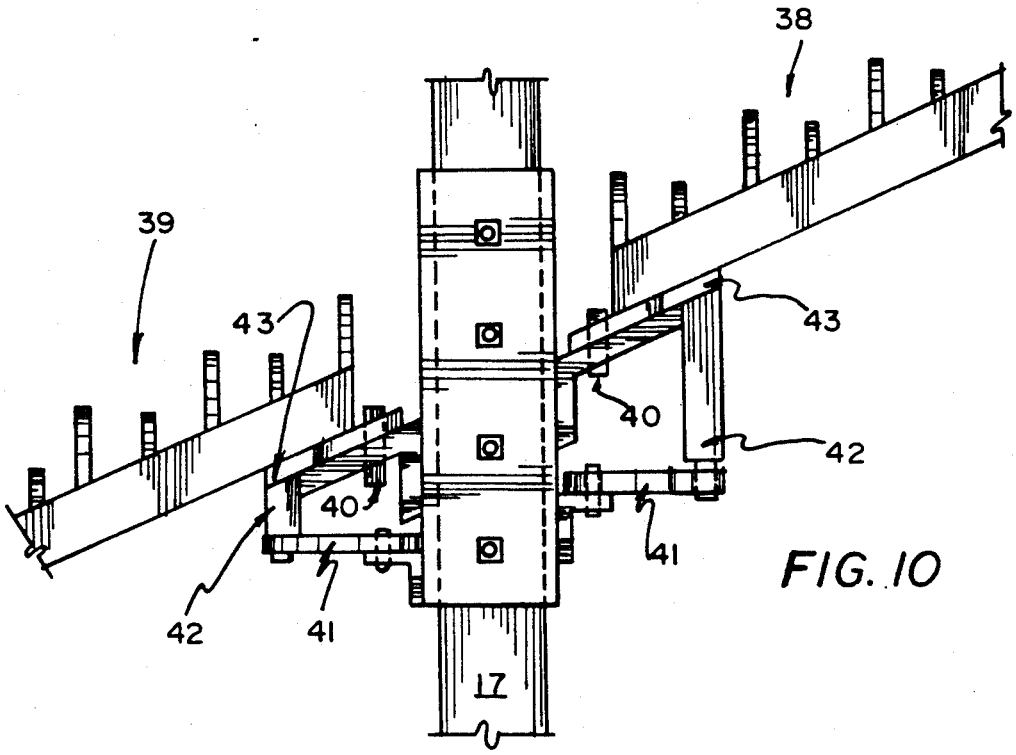
FIG. 10 is a plan view of a further alternative embodiment of a minefield clearing apparatus enlarged to show details of two plow face segments pivotally joined to a push beam assembly much of the apparatus being broken away.
Figure 11:
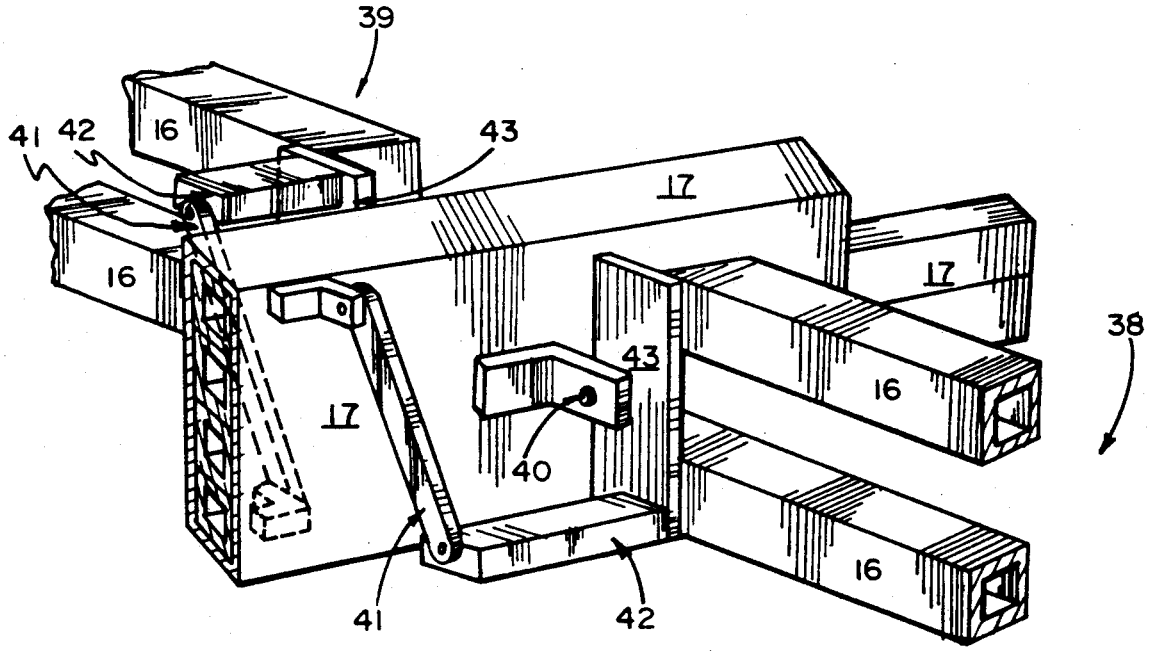
FIG. 11 is a perspective view of the alternative embodiment of a minefield clearing apparatus shown in FIG. 10 enlarged to show details of the pivot mechanism, much of the apparatus being broken away.

A third embodiment of a minefield clearing apparatus is shown in FIGS. 10 and 11. Whereas each of the previously discussed embodiments were equipped with a single plow face 4 extending traversely of the path of forward travel of tank 2, it is desirable to divide the plow face into pivotable segments 38 and 39. Pivoting segments 38 and 39 permit a more consistent plowing depth across the length of the plow face by the apparatus moving across uneven terrain. Pivotal movement about pins 40 is accomplished as skid shoes 22 attached to the ends of segments 38 and 39, not shown in FIGS. 10 and 11, ride over uneven terrain raising or lowering segments 38 and 39 relative to central push beam assembly 17. Additional support for the pivot mechanism is provided by pivot bars 41 joined at on end to push beam assembly 17 and at the other to guide rods 42 extending from pivot plate 43 joining rails 16.

When the apparatus 1 is no longer required for a particular mine clearing operation, the plow face 4 and frame 6 can be disconnected from the interface assembly 3 mounted upon tank 2 by removal of pins 7. By means of a small winch (not shown) mounted upon the tank 2 or a third vehicle, the plow face and frame assembly 4 and 6 may be placed upon a small trailer (not shown) and transported to a desired location.

It is to be understood that the present minefield clearing apparatus is not limited to the embodiments described above but encompasses any and all embodiments within the scope of the following claims.

I claim:

1. A minefield clearing apparatus for attachment to a vehicle comprising:

an interface assembly adapted for mounting onto a vehicle;

plow means joined to said interface assembly for raising and shunting aside objects buried beneath the ground surface; and, conveyor means located behind said plow means for transporting the contents of the earth raised and shunted by said plow means, whereby during mine clearing operations the contents of the earth are transported to the rear of the vehicle along a line substantially parallel to the direction of travel of the vehicle.

2. The minefield clearing apparatus according to claim 1, wherein said plow means includes:

a plow face; and a frame for reinforcing said plow face and joining such to said interface assembly.

3. The minefield clearing apparatus of claim 2 wherein said plow face further includes:

a plurality of plow face segments each having a long axis, said segments having their long axes in parallel alignment;

means for pivotally mounting said plow face segments to said frame, whereby said mounting means permits pivotal movement of each said segment about an axis substantially parallel to the path of travel of the vehicle.

4. The minefield clearing apparatus according to claim 2 wherein said plow face is angularly joined to said interface assembly, whereby the contents of the earth will be deposited as a single berm adjacent to the side of the vehicle when said plow face is disposed below the ground surface and moved forward.

5. The minefield clearing apparatus according to claim 2 wherein said plow means includes:

a rake extension member angularly joined to said frame for shunting aside mines, whereby the contents of the earth uncovered during mine clearing operations are directed toward the centerline of the vehicle and toward said conveyor means.

6. The minefield clearing apparatus according to claim 2 wherein said plow face includes:

a plurality of vertically disposed teeth said teeth being insertable into the ground; and a plurality of horizontal stiffening members, said stiffening members being vertically separated from one another and joining adjacent said teeth.

7. The minefield clearing apparatus according to claim 2 wherein said frame further includes:

a transverse push beam pivotally joined to said interface assembly;

plow face reinforcement means upon which said teeth are mounted;

a plurality of push beam assemblies each said assembly joined at one end to said transverse push beam and at the other to said reinforcement means, whereby forces generated as said plow face is moved through the ground during minefield clearing operations are transmitted from said plow face through said assemblies to said transverse push beam.

8. The minefield clearing apparatus according to claim 1, wherein said conveyor means includes:

a mine collecting chute adapted to be fitted against the side of the vehicle, whereby said chute forms a continuous channel from the front to the rear of the vehicle permitting movement of the contents of the earth uncovered by said plow means therein.

9. The minefield clearing apparatus according to claim 8, wherein said mine collecting chute includes:

a first continuous bell track means being engageable with the ground, said first track means capable of being rotated when the vehicle is driven over the ground surface;

a plurality of first side walls for retaining the contents of the earth uncovered by said plow means within said chute, said side walls positioned above said track means, and each of said walls being substantially parallel with each other;

a first conveyor belt positioned between said side walls forming the floor of said chute.

10. The minefield clearing apparatus according to claim 9 wherein said first continuous belt track means may be frictionally engaged with said first conveyor bet, whereby motion of the vehicle over the ground surface drives said belt.

11. The minefield clearing apparatus according to claim 1, wherein said conveyor means includes:

a mine collecting ramp means to funnel and lift the contents of the earth uncovered by said plow means to a height above the ground surface.

12. The minefield clearing apparatus according to claim 11, wherein said mine collecting ramp means includes:

a second continuous belt track means engageable with the ground, said second track means capable of being rotated when the vehicle is driven over the ground surface;

a ramp floor positioned above said second track means;

a plurality of second side walls joined to, and extending substantially vertically above, said ramp floor;

a second conveyor belt positioned above said second track means.

13. The minefield clearing apparatus according to claim 12, wherein said second track means may be frictionally engaged with said second conveyor belt, whereby motion of the vehicle over the ground surface drives said belt.

14. A minefield clearing apparatus for attachment to a vehicle comprising:

an interface assembly adapted for mounting onto a vehicle;

a frame pivotally joined to said interface assembly; and a plow face mounted upon said frame including:

a plurality of vertically disposed teeth for cutting and lifting the earth and the contents thereof said teeth being insertable into the ground; and a plurality of horizontal stiffening members, said stiffening members being vertically separated from one another, joining adjacent said teeth, and having a width substantially similar to that of said teeth.

15. The minefield clearing apparatus according to claim 14 wherein said plow face is angularly joined by said frame to said interface assembly, whereby the contents of the earth will be deposited as a single berm adjacent to the side of the vehicle when said plow face is disposed below the ground surface and moved forward.

16. The minefield clearing apparatus according to claim 14 wherein said plow face further includes:

a plurality of plow face segments each having a long axis, said segments having their long axes in parallel alignment;

means for pivotally mounting said plow face segments to said frame, whereby said mounting means permits pivotal movement of each said segment about an axis substantially parallel to the path of travel of the vehicle.

17. The minefield clearing apparatus according to claim 14 wherein said frame further includes:

a transverse push beam pivotally joined to said interface assembly;

plow face reinforcement means upon which said teeth are mounted;

a plurality of push beam assemblies, each said assembly joined at one end to said transverse push beam and at the other to said reinforcement means, whereby forces generated as said plow face is moved through the ground during minefield clearing operations are transmitted from said plow face through said assemblies to said transverse push beam.

* * * * *